US009280110B2

(12) United States Patent
Iino

(10) Patent No.: US 9,280,110 B2
(45) Date of Patent: Mar. 8, 2016

(54) IMAGE FORMATION APPARATUS

(71) Applicant: Brother Kogyo Kabushiki Kaisha, Nagoya-shi, Aichi-ken (JP)

(72) Inventor: Hikaru Iino, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/585,496

(22) Filed: Dec. 30, 2014

(65) Prior Publication Data

US 2015/0117926 A1 Apr. 30, 2015

Related U.S. Application Data

(63) Continuation of application No. 13/432,661, filed on Mar. 28, 2012, now Pat. No. 9,042,807.

(30) Foreign Application Priority Data

Aug. 18, 2011 (JP) ..... 2011-178818

(51) Int. Cl.
*G03G 15/00* (2006.01)
*G03G 21/00* (2006.01)
(Continued)

(52) U.S. Cl.
CPC ..... *G03G 15/234* (2013.01); *G03G 15/6529* (2013.01); *G03G 21/1619* (2013.01); *G03G 2215/0043* (2013.01); *G03G 2215/00675* (2013.01); *G03G 2215/00679* (2013.01)

(58) Field of Classification Search
CPC ..... G03G 15/00; G03G 21/00; G03G 15/234; G03G 2215/0043; G03G 2215/00675; G03G 2215/00679; G03G 15/6529; G03G 21/1619; B65H 85/00
USPC ..... 399/364, 401, 402
See application file for complete search history.

(56) References Cited

U.S. PATENT DOCUMENTS 5,689,754 A 11/1997 Yoshida et al.
6,553,207 B2 * 4/2003 Tsusaka et al. ..... 399/401
(Continued)

FOREIGN PATENT DOCUMENTS

CN 1815378 A 8/2006
JP 07-028337 1/1995
(Continued)

OTHER PUBLICATIONS

Jan. 30, 2015—(US) Notice of Allowance—U.S. Appl. No. 13/432,661.
(Continued)

*Primary Examiner* — Nguyen Ha
(74) *Attorney, Agent, or Firm* — Banner & Witcoff, Ltd.

(57) ABSTRACT

An image formation apparatus has a body having a pair of frames, and an image formation unit configured to form an image on a sheet, and a re-feeding path which is used when the sheet, on one surface of which an image has been formed by the image formation unit, is fed again to the image formation unit. The re-feeding path includes a first path vertically extending from a downstream side, in a sheet feed direction, of the image formation unit, a second path extending horizontally, and a curved portion connecting the first path and the second path. The pair of frames are connected with a metal plate which is formed and arranged to extend along the curved portion.

12 Claims, 8 Drawing Sheets

(51) Int. Cl.

| | |
|---|---|
| ***B65H 85/00*** | (2006.01) |
| ***G03G 15/23*** | (2006.01) |
| ***G03G 21/16*** | (2006.01) |

(56) References Cited

U.S. PATENT DOCUMENTS

| | | | | |
|---|---|---|---|---|
| 6,980,766 | B2 | 12/2005 | Ito | |
| 7,529,506 | B2 | 5/2009 | Ogawa | |
| 7,680,449 | B2 | 3/2010 | Shimizu | |
| 8,055,181 | B2 | 11/2011 | Murayama | |
| 8,447,223 | B2 * | 5/2013 | Inui | G03G 15/232 271/248 |
| 2004/0047641 | A1 | 3/2004 | Kato et al. | |
| 2004/0114979 | A1 | 6/2004 | Nanno | |
| 2004/0247337 | A1 | 12/2004 | Ohama et al. | |
| 2005/0214028 | A1 * | 9/2005 | Yasumoto | G03G 15/231 399/124 |
| 2007/0147920 | A1 | 6/2007 | Shimizu | |
| 2007/0222144 | A1 | 9/2007 | Inui et al. | |
| 2008/0080916 | A1 * | 4/2008 | Numazaki et al. | 399/379 |
| 2008/0175638 | A1 | 7/2008 | Murayama | |
| 2009/0060568 | A1 | 3/2009 | Ishikawa et al. | |
| 2009/0110457 | A1 | 4/2009 | Inui | |
| 2009/0202282 | A1 * | 8/2009 | Baek et al. | 399/397 |
| 2010/0092206 | A1 | 4/2010 | Matsushita et al. | |
| 2010/0158596 | A1 * | 6/2010 | Inoue | 399/401 |
| 2010/0194027 | A1 * | 8/2010 | Takagi | 271/3.19 |
| 2010/0232854 | A1 * | 9/2010 | Takagi | B65H 5/26 399/401 |
| 2010/0247136 | A1 | 9/2010 | Seto | |
| 2011/0102530 | A1 | 5/2011 | Yamamoto | |
| 2011/0102983 | A1 | 5/2011 | Souda et al. | |
| 2011/0262201 | A1 | 10/2011 | Souda | |

FOREIGN PATENT DOCUMENTS

| | | | |
|---|---|---|---|
| JP | H08110659 | A | 4/1996 |
| JP | 2002-148879 | A | 5/2002 |
| JP | 2007-176611 | A | 7/2007 |
| JP | 2008-162722 | A | 7/2008 |
| JP | 2009058740 | A | 3/2009 |
| JP | 2011-095495 | A | 5/2011 |

OTHER PUBLICATIONS

Office Action issued in corresponding Chinese Application No. 201210092472.5, dated Sep. 3, 2014.

Feb. 17, 2015—(JP) Notification of Reasons for Rejection—App 2011-178818.

* cited by examiner

IMAGE FORMATION APPARATUS

CROSS-REFERENCE TO RELATED APPLICATION

This application is a continuation of pending U.S. patent application Ser. No. 13/432,661, filed on Mar. 28, 2012, which claims priority under 35 U.S.C. §119 from Japanese Patent Application No. 2011-178818 filed on Aug. 18, 2011, the entire contents of which is incorporated herein by reference in its entirety.

TECHNICAL FIELD

The present invention relates to an image formation apparatus configured to perform a duplex printing, that is, to print images on both sides of a printing sheet.

CONVENTIONAL ART

Conventionally, an image formation apparatus capable of performing a duplex printing is provided with an image formation unit, and a re-feeding path. The re-feeding path is used to feed a printing sheet bearing an image on one surface toward the image formation unit so that another image is formed on the other surface of the printing sheet. Typically, in such a conventional image formation apparatus, the re-feeding path includes a first path extending along a rear wall of a main body of the image formation apparatus, a second path extending along a bottom wall of the main body, and a curved portion which is arranged at a corner formed by the rear wall and the bottom wall of the main body.

SUMMARY

Generally, in the image formation apparatus, four corners of a pair of frames constituting right and left walls of the main body are connected with reinforcing pipes. In such a structure, however, since the four corners are reinforce using four reinforcing pipes, the curved portion of the re-feeding path should be displaced so that the curved portion does not interfere with the reinforcing pipes. Therefore, the main body should be upsized.

In consideration of the above problem, the present invention is advantageous in that, in an image formation apparatus having a re-feeding path, a pair of frames can be reinforced without upsizing the body thereof.

According to aspects of the present invention, there is provided an image formation apparatus, which has a body having a pair of frames, and an image formation unit configured to form an image on a sheet, and a re-feeding path which is used when the sheet, on one surface of which an image has been formed by the image formation unit, is fed again to the image formation unit. The re-feeding path includes a first path vertically extending from a downstream side, in a sheet feed direction, of the image formation unit, a second path extending horizontally, and a curved portion connecting the first path and the second path. The pair of frames are connected with a metal plate which is formed and arranged to extend along the curved portion.

With this configuration, the pair of frames are connected with a metal plate which is formed to have a shape corresponding to the curved portion. Therefore, in comparison with a structure in which portions in the vicinity of the curved portion of the pair of frames are connected with reinforcing pipe, the pair of frames can be reinforced without upsizing the body of the image formation apparatus.

BRIEF DESCRIPTION OF THE ACCOMPANYING DRAWINGS

DETAILED DESCRIPTION OF THE EMBODIMENTS

Hereinafter, referring to the accompanying drawings, embodiments of the invention will be described. In the following description, a configuration of a color printer 1, which is a first exemplary embodiment of the invention, will be described.

First Embodiment

Figure 1:
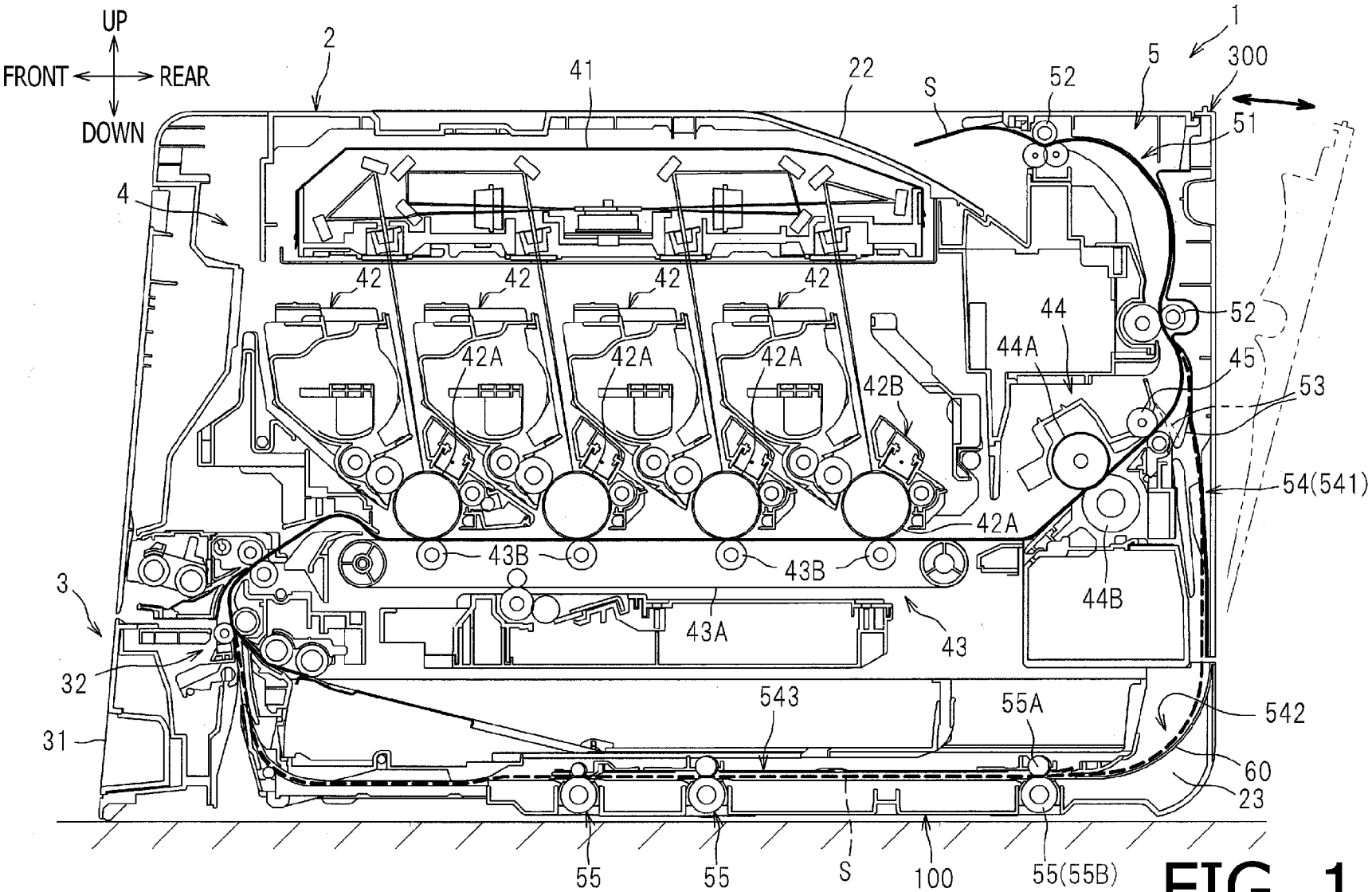
FIG. 1 is a cross-sectional side view of a color printer according to a first embodiment of the present invention.

In the following description, directions are indicated as those viewed by a user of the color printer 1. That is, in FIG. 1, a left-hand side is a "front side" of the color printer 1, a right-hand side is a "rear side" of the color printer 1. A farther side with respect to a plane of FIG. 1 is a "left side" of the color printer 1, while a closer side with respect to the plane of FIG. 1 is a "right side" of the color printer 1.

The color printer 1 is an apparatus capable of forming images on both sides of a sheet S. As shown in FIG. 1, the color printer 1 has a body 2, which accommodates a sheet supply unit 3, an image formation unit 4, and a sheet feed unit 5.

The sheet supply unit 3 is arranged at a lower portion inside the body 2. The sheet supply unit 3 includes a sheet supply tray 31, and a sheet feeding mechanism 32. The sheets S accommodated in the sheet supply tray 31 are fed to make a U-turn to proceed from the front side to the rear side, and is directed toward the image formation unit 4. It is noted that the sheet supply tray 31 can be detached by pulling the same with respect to the body 2. By pushing the sheet supply tray 31 toward the rear side, it can be operatively coupled to the printer 1.

The image formation unit 4 is for forming images on the printing sheets S fed from the sheet supply unit 3, and is arranged above the sheet supply tray 31. The image formation unit 4 has an exposure unit 41, four process units 42, transfer units 43 and a fixing unit 44.

The exposure unit 41 is arranged in an upper portion of the body 2. Similar to conventionally-known ones, the exposure unit 41 is provided with a laser source, a polygonal mirror, a plurality of lenses and a plurality of mirrors.

The process units 42 are arranged in the front-to-rear direction, and are arranged between the sheet supply tray 31 and the exposure unit 41. Each process unit 42 includes a photoconductive drum 42A, a charger 42B, a developing roller, a toner supply roller, a toner thickness regulation blade and a toner container. The four process units 42 are different in that the color of the toner contained in the toner containers is different, but have substantially the same structures.

The transfer units 43 are arranged between the sheet supply tray 31 and respective process units 42. The transfer unit 43 includes an endless feed belt 43A wound around a driving roller and a driven roller, and four transfer rollers 43B. The feed belt 43A is configured such that the upper outer surface thereof faces the photoconductive drums 42A. The four transfer rollers 43B are arranged at position opposite to the four photoconductive drums 42A with the upper part of the feed belt 43A located therebetween such that the upper part of the feed belt 43A is nipped by the four photoconductive drums 42A and the four transfer rollers 43B, respectively.

The fixing unit 44 is arranged at a position on the rear side of the process units 42. The fixing unit 44 includes a heat roller 44A and a pressure roller 44B which is arranged to face the heat roller 44A and is urged toward the heat roller 44A.

In the image formation unit 4, the circumferential surface of each photoconductive drum 42A is uniformly charged by the charger 42B and then exposed to a laser beam emitted by the exposure unit 41 so that an electrostatic latent image is formed thereon in accordance with image data. The toner contained in the toner container is supplied to the developing roller via the toner supply roller. The toner thickness blade regulates the thickness of the toner supplied to the developing roller, thereby the developing roller bears a layer of the toner having a predetermined thickness.

As the toner carried on the developing roller is supplied onto the circumferential surface of the photoconductive drum 42A on which the electrostatic latent image is formed, the latent image is developed (i.e., turns to a visible image) and a toner image corresponding to the latent image is formed on the circumferential surface of the photoconductive drum 42A. Then, when the printing sheet S fed by the feed belt 43A so as to be fed between the photoconductive drums 42A and the transfer rollers 43B, the toner images formed on the photoconductive drums 42A are transferred onto the printing sheet S subsequently.

The printing sheet S on which the toner images are transferred is fed through the nip between the heat roller 44A and the pressure roller 44B, thereby the toner images are heated/pressed and fixed on the printing sheet S. The printing sheet S on which the fixed image is formed is fed, by the feed roller 45, from the fixing unit 44 to the feeding path 51.

The feed unit 5 serves as a sheet discharge mechanism that discharges the printing sheet S fed from the image formation unit 4 to outside of the body 2. The feed unit 5 also serves as a re-feed mechanism which functions to re-feed the printing sheet S bearing a fixed image on one side to the image formation unit 4 with front/bask side being reversed. Specifically, the feed unit 5 includes the feeding path 51, a flapper 53 which is swingable in the front and rear direction, a re-feeding path 54, a plurality of pairs of re-feed rollers 55 (55A and 55B) which are arranged along the re-feeding path 54 to feed the sheet S.

The feeding path 51 is arranged at a rear side in the body 2 so as to extend from a position on the front side of the flapper 53 when swung rearward (indicated by solid line in the drawing) in the vicinity thereof to upper side, then curved and directed frontward.

The feed rollers 52 are configured to rotate in forward/reverse direction. When rotating forwardly, the feed rollers 52 discharge the printing sheet S fed from the image formation unit 4 to the outside. When rotated reversely, the feed rollers 52 feed the printing sheet S to move the sheet S inwardly.

The re-feeding path 54 is a path to feed the printing sheet S, on one surface of which the image formation unit 4 has already formed an image, to the image formation unit 4 again. The re-feeding path 54 is formed from the rear portion of the body 2 and extends in a lower portion of the body 2. Specifically, the re-feeding path 54 includes a first path 541, a curved portion 542 and a second path 543.

The first path 541 extends from a position in the vicinity of a rear side of the flapper 53 when swung frontward to downside as indicated by broken lines.

The curved portion 542 is a passage connecting the first path 541, which extends vertically (i.e., in the up-and-down direction), and the second path 543 which extends horizontally. The curved portion 542 curves from the lower end of the first path 541 toward the front side. It is noted that the "horizontal" in this description may include a direction slightly inclined with respect the accurate horizontal direction.

The second path 543 horizontally (i.e., substantially horizontally) extends from the curved portion 542 toward the front side, and then bent upward toward the sheet feed mechanism 32.

In the feed unit 5, when the image formation has been finished, the sheet S fed from the image formation unit 4 is fed through the feeding path 51, discharged to outside of the body 2, by the forwardly rotating feed roller 52, and the sheet S is placed on the discharged sheet tray 22. If an image has been formed on one side of the sheet S and another image is to be formed on the other side of the sheet S, the feed roller 52 is reversely rotated before the sheet S is completely discharged out of the body 2. Then, the sheet S is drawn back inside the body 2, and fed from the feeding path 51 to the re-feeding path 54. Thereafter, the sheet S is fed through the re-feeding path 54 by the re-feed rollers 55, and fed to the image formation unit 4 by the sheet feed mechanism 32.

When images are formed on both sides, the printing sheet S is fed from the image formation unit 4 to the feeding path 51, and then, fed by the forwardly rotated feed rollers 52 so that the printing sheet S is discharged from the body 2 and placed on the discharged sheet tray 22.

The curved portion 542 is formed of a metal plate 60, and a part of the second path 543 is formed by the re-feed unit 100.

Specifically, the metal plate 60 is formed such that its cross section has an arc shape, and arranged along the curved portion 542. The metal plate 60 extends in the right-and-left direction and both ends are connected to a pair of right-and-left side frames 23, respectively. The metal plate 60 is formed to have a cross section which is convex to outside of the body 2.

By connecting the pair of side frames 23 with the metal plate 60*b* which has a shape along the curved portion 542, it becomes possible to reinforce the side frames 23 without upsizing the body 2 in comparison with a case where the curved portion of the side frames are connected with reinforcing pipes as is done in the conventional structure. Further, since the metal plate 60 forming the curved portion 542 also serves to reinforce the pair of side frames 23, the structure can be simplified in comparison with a case where other members for configuring the curved portion separately from the metal plate.

The re-feeding unit 100 is configured to include resin material, and provided adjacent to the metal plate 60 on the front side thereof, below the sheet supply tray 31. That is, the re-feeding unit 100 is configured to be separate from the metal plate 60 and contain the resin, the structure can be simplified since the re-feed rollers 55 and the like can easily be provided in comparison with a case where the second path is formed by extending the metal plate forming the curved portion.

Figure 2:
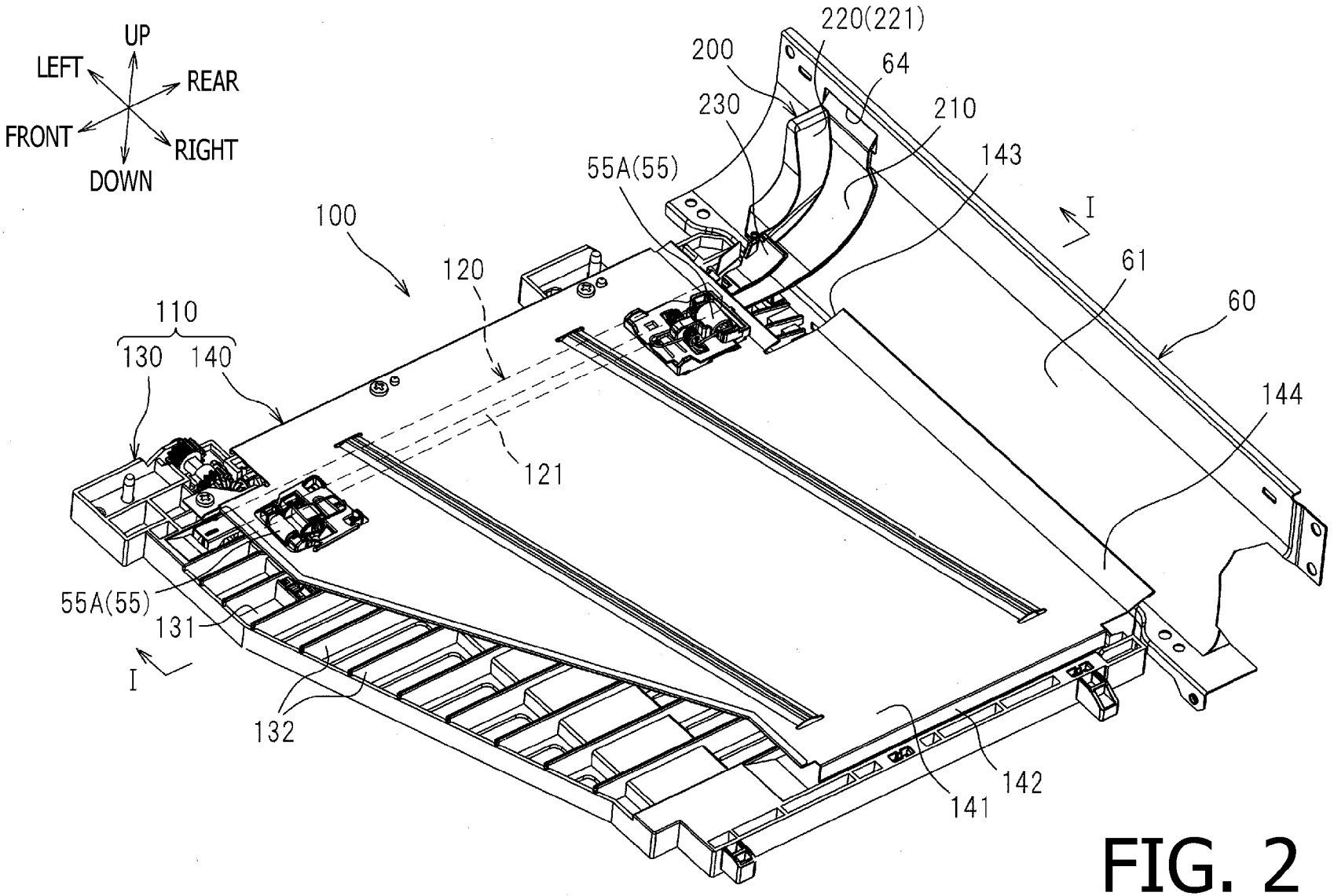
FIG. 2 is a perspective view showing a re-feeding unit, a metal plate and a guide member.

The re-feeding unit 100 is fixed to the body 2. The sheet supply tray 31 can be detachably coupled (inserted/removed), in the front-and-rear direction with respect to the re-feeding unit 100 and the body 2. The re-feeding unit 100 has a substantially flat planar shape as shown in FIG. 2, and includes a guide body 110, an end regulation member 120 and two pairs of re-feeding rollers 55.

The guide member 110 includes a lower feeding member 130 and an upper feeding member 140, which are arranged to have a predetermined distance in the up-and-down direction, thereby defining the second path 543 between the lower feeding member 130 and the upper feeding member 140.

The lower feeding member 130 is a resin member, and has a width wider than a width (i.e., a length in the right-and-left direction) of the sheet S. The lower feeding member 130 includes a bottom wall portion 131 and first ribs 132.

Figure 3:
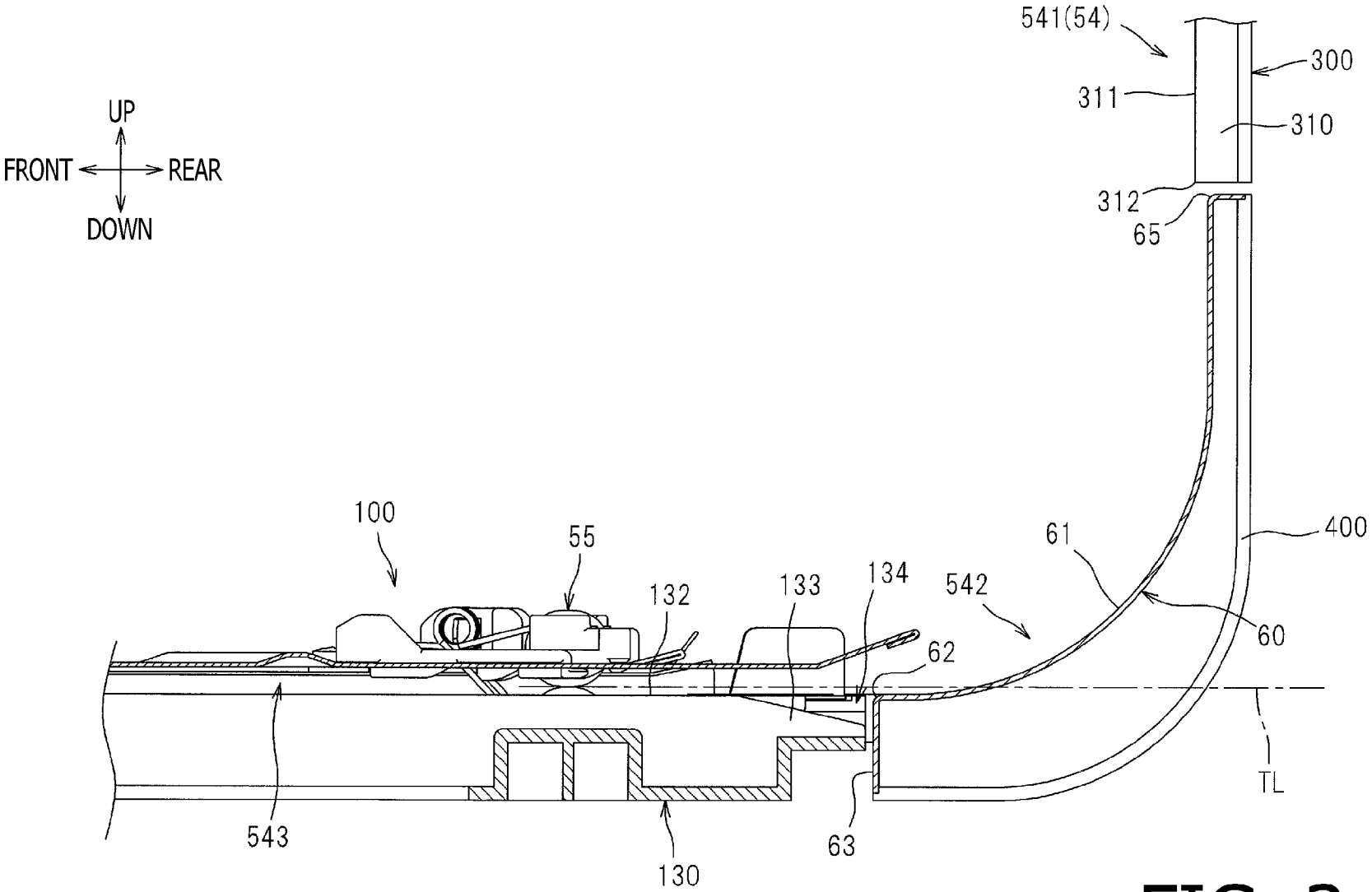
FIG. 3 is a cross-sectional view of the re-feeding unit, the metal plate and the guide member, which are shown in FIG. 2, taken along line I-I of FIG. 2.

The first ribs 132 are for supporting the printing sheet S from below and guiding the same. The first ribs 132 protruded upward from the bottom wall portion 131, and extend in the feeding direction of the sheet S. The first ribs 132 are arranged to be spaced from each other in the width direction of the sheet S. As shown in FIG. 3, at an end portion of each first rib 132 (i.e., at an upstream side end portion in the sheet feed direction S), an inclined portion 133 is defined. The inclined portion 133 of each first rib 132 inclines from a position lower than the front end 62 of the guide surface 61, which guides the sheet S, of the metal plate 60, toward the front side.

In other words, the rear end portion of the lower feeding member 130 is arranged at a lower level with respect to the front end portion of the metal plate 60. With this configuration, when the sheet S passes through a connected portion between the metal plate 60 and the lower feeding member 130, the leading end of the sheet S is prevented from being tripped by the lower feeding member 130.

In front of the metal plate 60, a flange portion 63, which extends downward from the front end of the guide surface 61, is formed. A font surface of the flange portion 63 (i.e., the front side end of the metal plate 69) and the inclined portion 133 define a concave portion 134 which is recessed with respect to a plane including a common tangential line TL to the pair of re-feed rollers 55.

Since the concave portion 134, which is recessed in the downward direction with respect to the common tangential line LT to the pair of re-feed rollers 55, on the second path 543, between the re-feed rollers 55 and the curved portion 542, downward bending of the sheet S when the sheet S contacts the re-feed rollers 55 can be absorbed by the concave portion 134, and a jam of the sheet S in the vicinity of the re-feed rollers 55 can be prevented.

The upper feeding member 140 is made of metal plate, and, as shown in FIG. 2, has an upper wall portion 141 which is wider than the width of the sheet S, and both side end portions 142 which are formed by bending the side portions (in the width, or right-and-left direction) downwardly. The upper feeding member 140 is arranged to be spaced from the lower feeding member 130 as the side end portions 142 are fixed on the lower feeding member 130. Between the upper wall portion 141 and the lower feeding member 130, an end regulating member 120 is arranged.

The end regulating member 120 is a member which contacts the left side end of the sheet S to regulate the position of the left side end of the sheet S. The end regulating member 120 is an elongated member extending in the front-and-rear direction, and provided at the left side position of the lower feeding member 130. On the left side of the upper feeding member 140, two incline rollers 55A which feed the sheet S with making the sheet S approach the end regulation member 120 are arranged along the front-and-rear direction with a space therebetween.

Each incline roller 55A is one of the pair of re-feed rollers 55, and the other one of the pair of re-feed rollers 55 is a drive roller 55B (see FIG. 1) arranged on the lower feeding member 130. Each incline roller 55A is inclined with respect to the drive roller 55B.

With the above configuration, as the drive roller 55B is rotated, the incline roller 55A which is driven by the drive roller 55A feeds the sheet S leftward, thereby the sheet S approaching the end regulating member 120.

On the rear side of the end regulation member 120, a guide member 200 for guiding the sheet S to inner side, in the right-and-left direction with respect to the end regulation member 120 is provided. Specifically, on the left side of the rear portion of the upper feeding member 140, a cutout portion 143 having a concave shape is formed. The guide member 200 is arranged such that the front portion thereof is inserted in the cutout portion 143 and extends from the metal plate 60 to the lower feeding member 130.

The guide member 200 has a lower wall portion 210 which supports the sheet S from the down side, a side wall portion 220 which inwardly protrudes from the left side portion of the lower wall portion 210, and an upper wall portion 230 which protrudes inwardly, in the right-and-left portion, from the front portion of the side wall portion 220 and faces the lower wall portion 210 in the up-and-down direction.

The lower wall portion 210 is formed to have an arc-shaped cross section extending along the guide surface 61 of the curved metal plate 60. The upper portion of the lower wall 210 passes through an engaging hole 64 formed on the left side of the metal plate 60 and engages with the outer surface of the metal plate 60, thereby the lower wall portion 210 is fixedly held by the metal plate 60. The lower end of the lower wall portion 210 is formed to extend from the metal plate 60 toward the lower feeding member 130 side, and arranged above the upper surfaces (which support the sheet S) of the first ribs 132.

With the above configuration, when the sheet S is fed from the metal plate 60 to the lower feeding member 130, trip of the sheet S at a connecting portion of the metal plate 60 and the lower feeding member 130 can be prevented by the lower wall portion 210 of the guide member 200.

As shown in FIG. 2, the side wall portion 220 has a first guide surface 221 which extends from a position on the outside, in the right-and-left direction, of the regulation surface 121 of the end regulating member 120 toward the regulating surface 121. If the sheet S is fed such that the left side end thereof is displaced leftward with respect to the regulation surface 121, the left side end of the sheet S is guided to approach the regulation surface 121 by the first guide surface 221. Therefore, trip of the sheet S at the rear end portion of the end regulating member 120 can be prevented.

Figure 4:
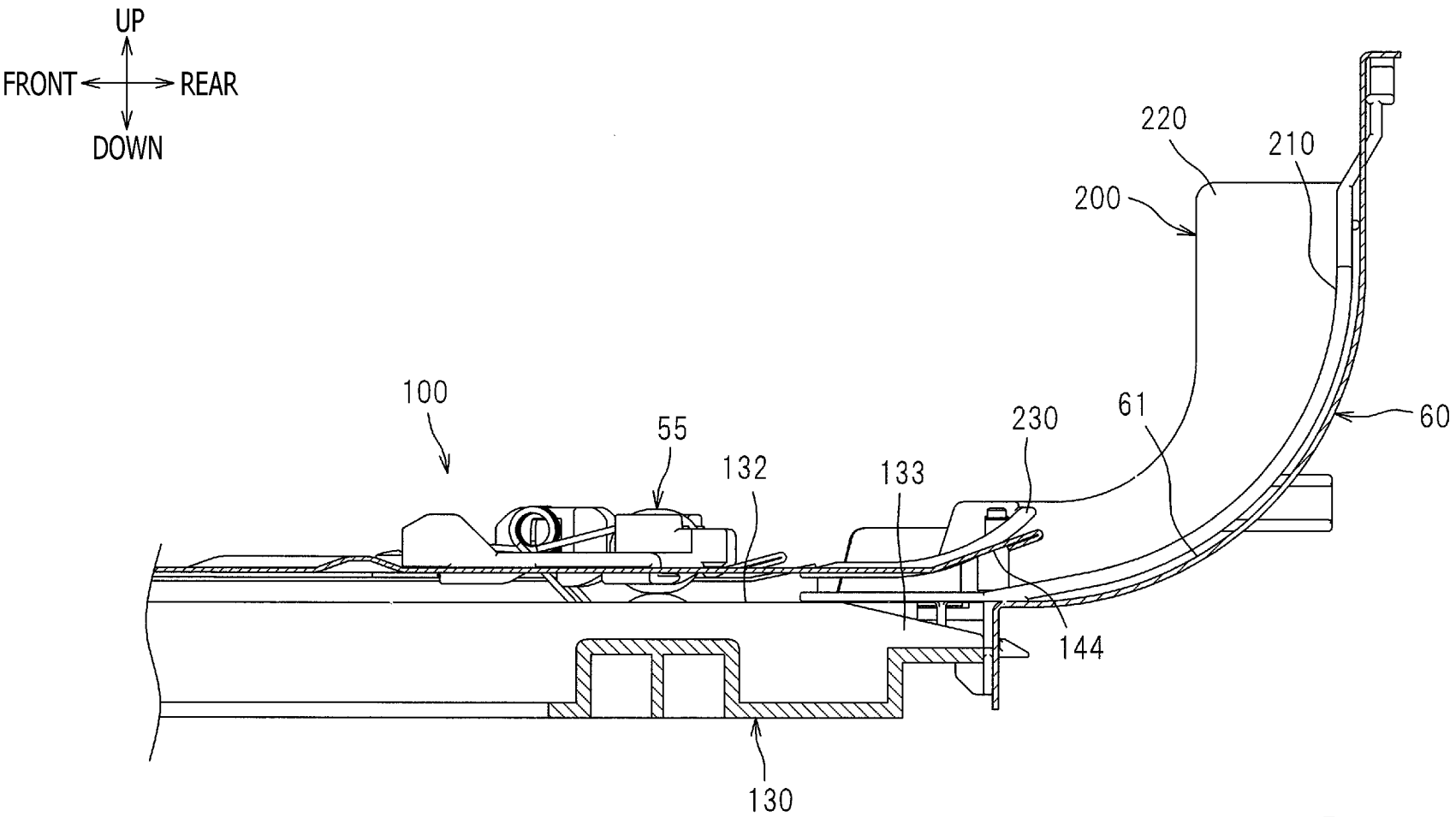
FIG. 4 is a cross-sectional view similar to FIG. 3 but a cover member and a rear cover are omitted, and the guide member is shown.
Figure 5:
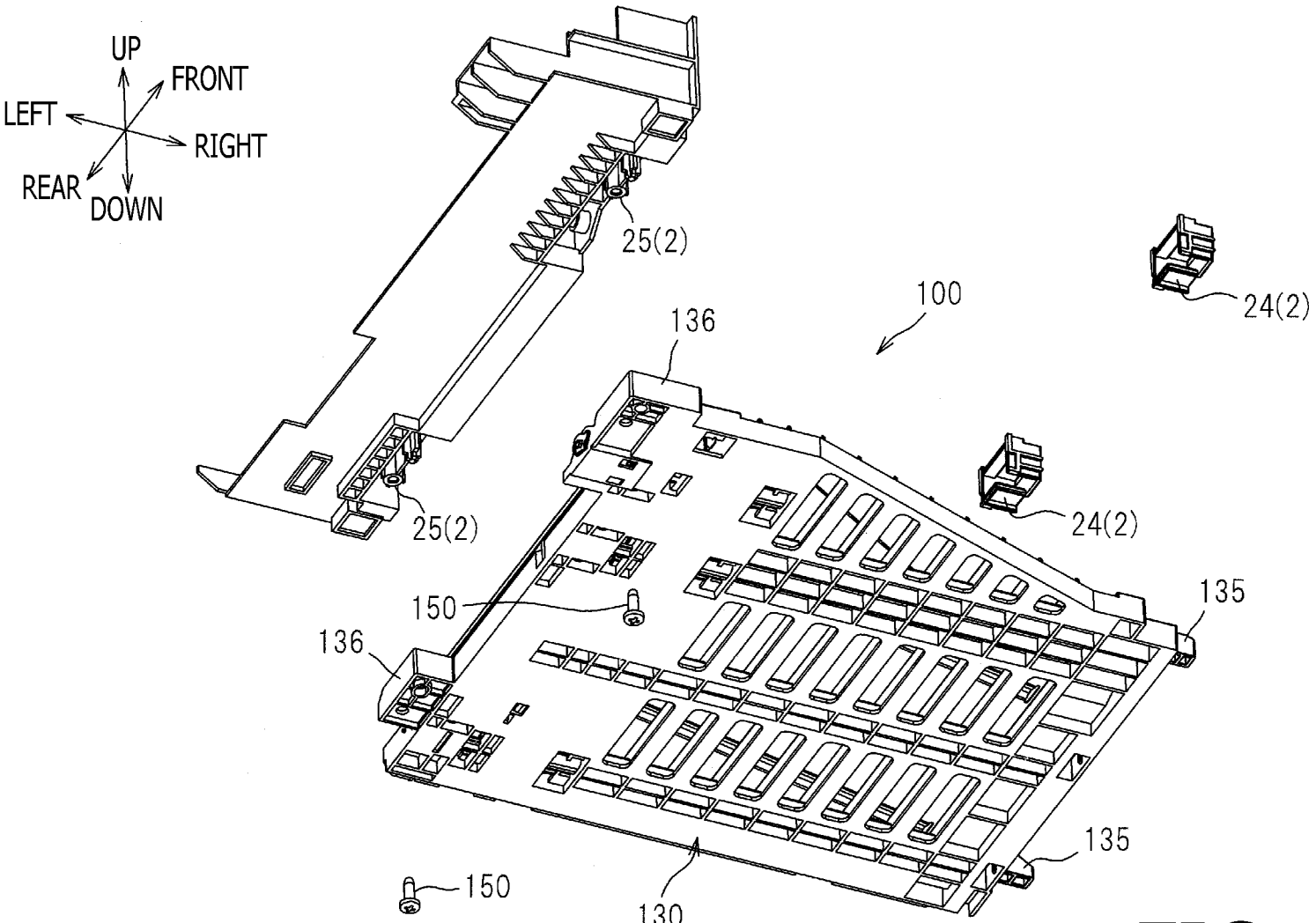
FIG. 5 is an exploded perspective view illustrating an attaching structure for attaching the re-feeding unit to the main body.

As shown in FIG. 4, the upper wall portion 230 is formed to extend from the rear end portion of the lower feeding member 130 to the front end portion of the metal plate 60. That is, in a view along the up-and-down direction, the upper wall portion 230 is formed to extend from a position where the upper wall portion 230 overlaps the lower feeding member 130 to a position where the upper wall portion 230 overlaps the metal plate 60. The upper wall portion 230 is inclined such that the portion closer to the upstream side end is located at a higher position. A right side portion 144 (a portion next to the cutout portion 143 in the right-and-left direction) of the upper feeding member 140 is, similar to the upper wall portion 230, formed, in a view along the up-and-down direction, to extend from the position where the right side portion 144 overlaps the lower feeding member 130 to the position where the right side portion 144 overlaps the metal plate 60. The right side portion 144 is inclined such that the upstream side portion is located at a higher position.

Then, the right side portion 144 and the upper wall portion 230 are arranged to overlap when viewed in the right-and-left direction. With this configuration, a sheet entering angle with respect to the re-feed unit 100 is made small, the sheet S can be fed smoothly from the metal plate 60 to the re-feed unit 100.

If the right side portion 144 and the upper wall portion 230 are not provided, when the leading end of the sheet S fed along the metal plate 60 reaches the lower feeding member 130, the sheet S may be separated from the guide surface 61 of the metal plate 60, which is curved, and extend substantially perpendicularly, due to the rigidity of the sheet S. Then, the entering angle of the sheet S with respect to the second path 540 which extends horizontally becomes larger. As a result, it becomes difficult to feed the sheet S to the second path 543 smoothly. In contrast, according to the embodiment, the upper wall portion 230 and the right side portion 144 prevents the sheet S from being separated from the guide surface 61 of the metal plate 60, the entering angle of the sheet S with respect to the re-feed unit 100 can be made smaller so that the sheet S can be fed from the metal plate 60 to the re-feed unit 100 smoothly.

As shown in FIG. 2, the re-feed rollers 55 are arranged to be closer to the end regulating member 120. The re-feed rollers 55 can feed the sheet S obliquely with respect to the feeding direction of the sheet S to make the left side end of the sheet S contact the end regulating member 120. One pair of the two pairs of the re-feed rollers 55 are arranged in the vicinity of the rear end of the cutout portion 143, while the other pair of the re-feed rollers 55 are arranged in the vicinity of the front end of the upper feeding member 140.

As shown in FIG. 1, the re-feed roller 55 on the most upstream side, in the feeding direction, within the second path 543 is configured to have a lower rotation speed than the feed roller 52 that is arranged on the upstream side of the re-feed roller 55. If the rotation speed of the re-feed roller 55 is faster than the feed roller 52, there occur various troubles. That is, if the sheet S is pulled between the re-feed roller 55 and the feed roller 52, the sheet S may be damaged, and/or as the re-feed roller 52 slips on the sheet S, the re-feed roller 52 may be damaged. According to the embodiment, by employing the above configuration, such problems can be avoided. It is noted that, as the feeding speed of the feed roller 55 is lower than the feeding speed of the re-feed roller 52, the sheet S contacting the feed roller 55 may be curved easily. However, such a curve can be absorbed by the concave portion 134 (see FIG. 3).

The re-feed unit 100 configured as described above is formed as a unit separated from the body 2. The right side end portion (i.e., a portion opposite to the end regulating member 120 in the width direction) of the re-feed unit 100 engages with the body 2, while the left side end portion (i.e., the end portion closer to the end regulating member 120) is secured to the body 2 with securing member such as screws. Specifically, at a front portion and a rear portion of the right surface of the lower feeding member 130, engaging protrusions 135 are provided to extend outwardly in the right-and-left direction, respectively, and engaging protrusions 136 are provided at the front and rear portions on the left surface of the lower feeding member 130 to extend outwardly in the right-and-left direction, respectively.

The two engaging protrusions 135 are placed on engaging fins 24 formed on the body 2, respectively, and the two engaging protrusions 136 are inserted in the two screw holes formed on the body 2 and secured thereat by screws, respectively. With this configuration, the end regulation member 120 can be positioned with respect to the body 2 accurately by screwing. Further, since the right side of the re-feed unit 100 is not fastened, attaching/removing of the re-feed unit 100 with respect to the body 2 can be made easier.

As shown in FIG. 3, on the upstream portion of the metal plate 60, a rear cover 300 is provided. Inside the rear cover 300, a plurality of second ribs 310 inwardly protruding are arranged at intervals therebetween.

The inner surface of each of the second ribs 310 serves as a second guide surface 311 for feeding the sheet S toward the metal plate 60. The upstream side end portion 65 of the metal plate 60 is located on the rear side (i.e., a further side from the sheet S) with respect to the end portion 312 of the second guide surface 311. With this configuration, when the sheet S is fed from the second ribs 312 to the metal plate 60, the leading end of the sheet S is prevented from being tripped by the metal plate 60.

As shown in FIG. 1, the rear cover 300 is supported such that it is rotatable with respect to the body 2. With this configuration, if the sheet S is jammed in the first path 541, the sheet S can be removed easily from the first path 541 by rotating the rear cover 300 to expose the first path 541 to outside.

Further, as shown in FIG. 3, a cover member 400 made of resin is provided to cover the metal plate 60 from the downstream end of the rear cover 300 to the upstream end of the re-feed unit 100. With this configuration, the metal plate 60 is prevented from directly touched by a user, deforming of the metal plate 60, which forms the curved portion 542 of the re-feeding path 54.

Second Embodiment

Next, a second embodiment will be described. It is noted that the second embodiment is a modification of the first embodiment. Therefore, components similar to those in the first embodiment are assigned with the same reference numbers and description thereof is omitted for brevity.

Figure 6:
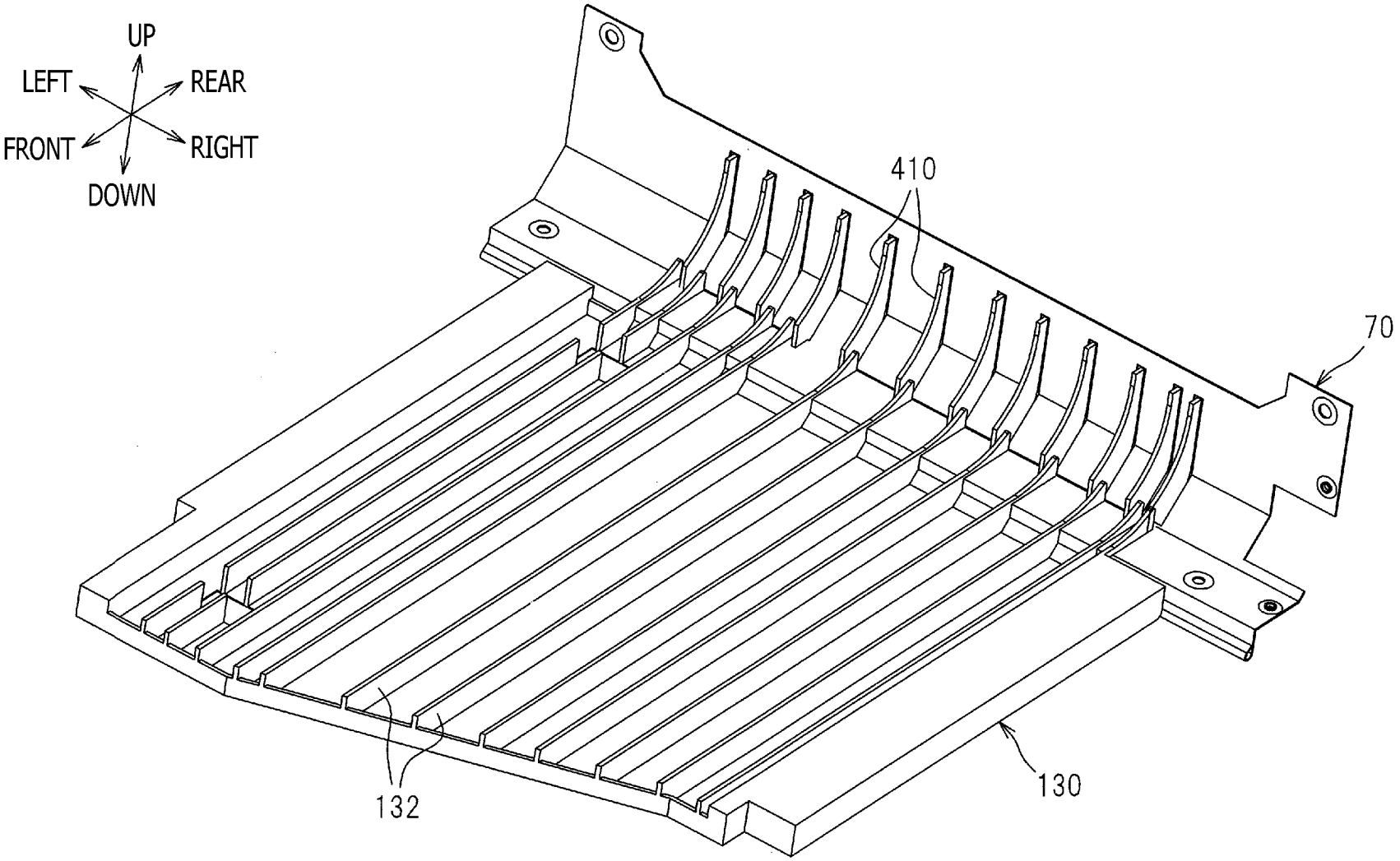
FIG. 6 is a perspective view showing a re-feeding unit and a metal plate according to a second embodiment.

As shown in FIG. 6, according to the second embodiment, a plurality of ribs 410 that extend in the feeding direction and guide the sheet S are provided on the inner surface of a metal plate 70. According to the configuration, since the sheet S is guided by a relatively thinner surface of the ribs 410, frictional resistance applied to the sheet S when the sheet S is fed can be reduced in comparison with a case where a relatively wide guide surfaces 61 guide the sheet S as in the first embodiment.

Figure 7:
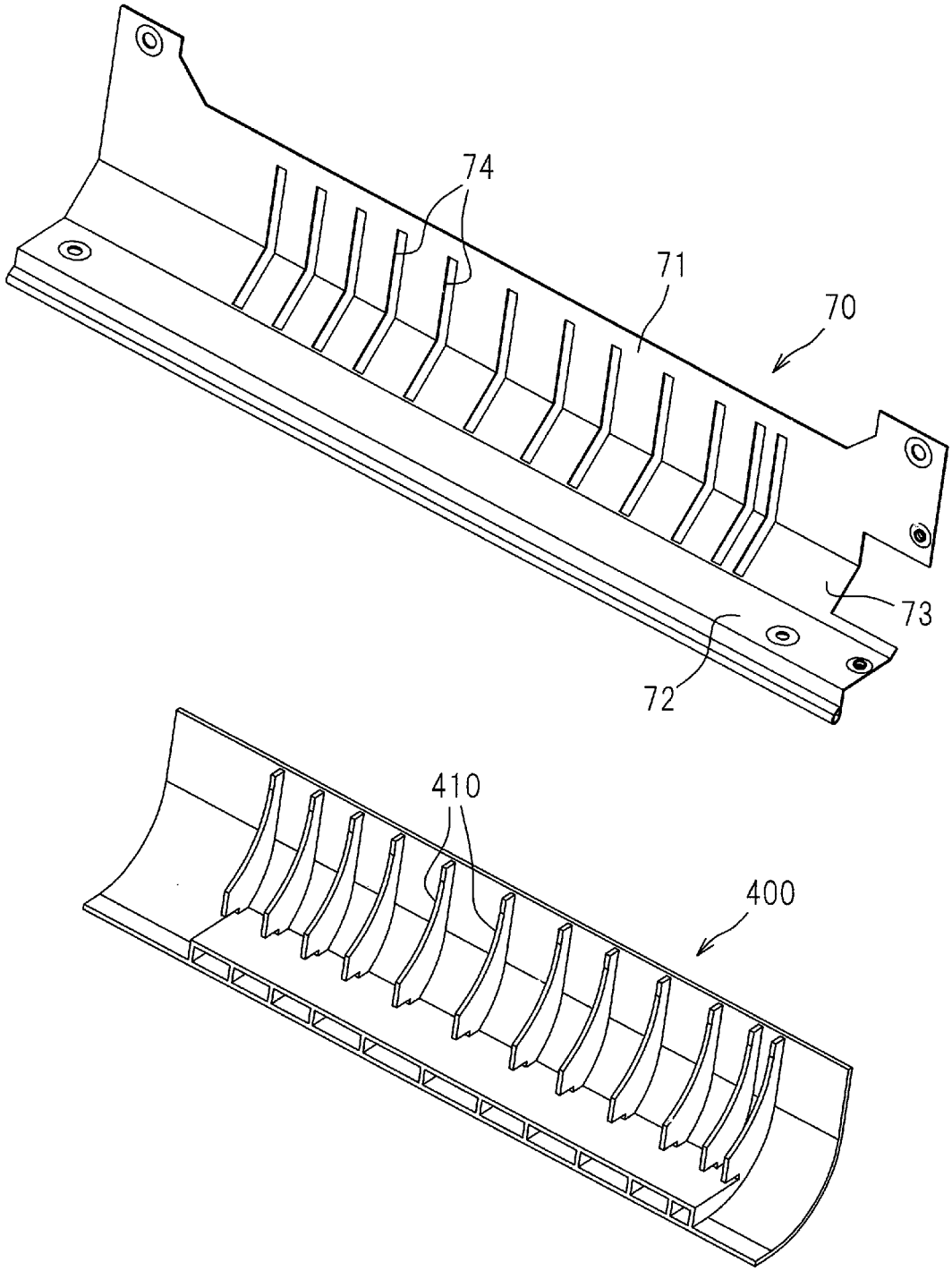
FIG. 7 is an exploded perspective view showing the metal plate and the cover member according to the second embodiment.

As shown in FIG. 7, the metal plate 70 has a polygonal shape (see FIG. 8) so that the outline is formed along the curved portion 542. The polygonal shape includes a rear wall portion 71 mainly extending in the up-and-down direction, a lower wall portion 72 extending horizontally, and an inclined wall portion 73 extending obliquely and connecting the lower end of the rear end wall portion 71 and the rear end of the lower wall portion 72. On the rear end wall portion 71 and the inclined wall portion 73, a plurality of slits 74 extending in the feeding direction are formed, which slits 74 are arranged in the right-and-left direction with intervals therebetween.

The plurality of ribs 410 are formed on a cover member 400 that coves the metal plate 70 from outside. The plurality of ribs 410 are arranged corresponding to the slits 74 so that the plurality of ribs 410 protrude inwardly through the plurality of slits 74 when the cover 400 and the metal plate 70 are assembled with the body 2.

With this configuration, the plurality of ribs 410 can be provided inside the metal plate 70 without an insert molding. Therefore, with this configuration, a manufacturing cost can be suppressed.

Figure 8:
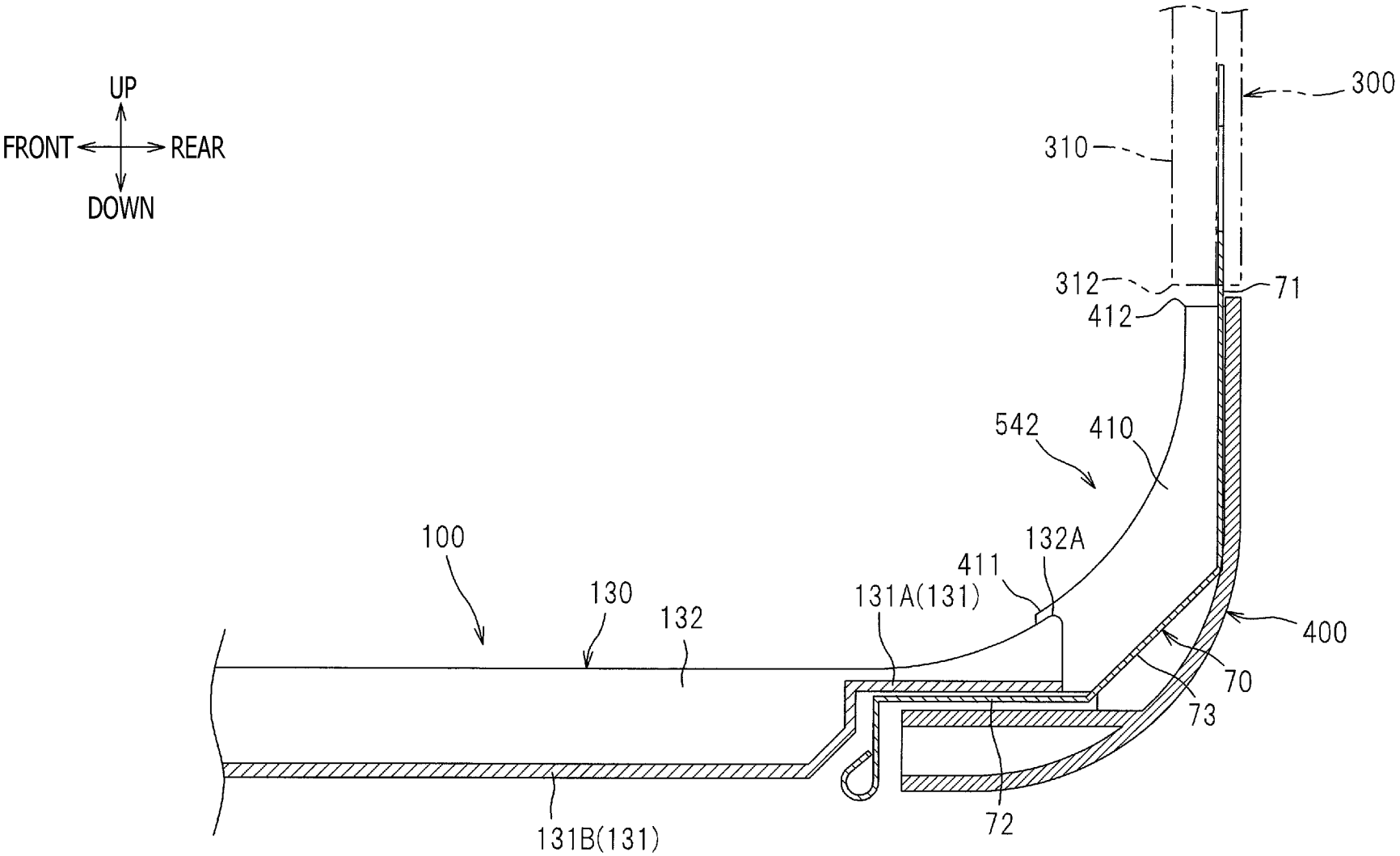
FIG. 8 is a cross-sectional view of the re-feeding unit at a portion in the vicinity of the metal plate according to the second embodiment.

As shown in FIG. 8, an upstream side end portion of the lower feeding member 130, more specifically, the rear end portion 131A of the lower wall portion 131 is arranged one step higher than the front portion 131B thereof, and overlapped, in the up-and-down direction, on the lower wall portion 72 of the metal plate 70. With this configuration, a connecting portion between the metal plate 70 and the re-feed unit 100 can be strengthened.

The upstream side end portions 132A of the first ribs 132 overlap the downstream side end portion 411 of the metal-plate side ribs 410, when viewed in the right-and-left direction. With this configuration, by overlaying the ribs 132 and 410, respectively, the connection line is omitted. Further, the first ribs 132 are arranged at a lower level than the metal-plate side ribs 410. Thus, the sheet S is prevented from being tripped at the first ribs 132.

The upstream side end portions 412 of the metal-plate side ribs 410 are arranged on the rear side (i.e., a side further from the sheet S) with respect to the downstream side end portions 312 of the second ribs 310 of the rear cover 300. With this configuration, when the sheet S is fed from the second ribs 310 toward the metal-plate side ribs 410, the leading end of the sheet S can be prevented from being tripped by the metal-plate side ribs 410.

It should be noted that the present invention needs not be limited to the above-described exemplary embodiments, but can be modified in various ways.

For example, in the second embodiment, the metal-plate side ribs 410 are formed on the cover member 400 which is arranged outside the metal plate 70. This configuration is only an example, and can be modified such that resin ribs may be integrally formed with the metal plate 70 by the insert molding. For another example, the metal-plate side ribs may be formed with a part of the metal plate by cutting and bending the metal plate.

In the embodiment, as the sheet S, thick paper, post cards, thin papers are described. The invention needs not be limited to such a sheet, and for example, an OHP (over head projector) can be used.

In the above-described embodiments, the image formation unit 4 is provided with the exposure unit 41. The invention needs not be limited to the configuration, and can be modified as in the examples described below. For example, instead of the exposure unit 41, an LED head may be employed, and/or instead of the photoconductive drum 42A, a photoconductive belt may be employed. Further, instead of the heat roller 44A, a cylinder-shaped fixing film which is slidably supported by guide members. Still further, instead of the transfer roller 43B, other members (e.g., conductive brush, conductive plate spring, etc.) to which transfer bias can be applied can be employed.

According to the embodiments and modification, the color printer 1 is described. However, the invention needs not be limited to the configurations of the embodiments and the modification. For example, the invention can be applied to a monochromatic printer, or other image formation devices such as copier, or MFP (multi-function peripheral) can be employed.

In the above-described embodiments and modifications, as a fastening member, the screw 150 is employed. However, the invention needs not be limited to such a configuration, and other members such as a volt and a nut can be employed.

What is claimed is:

1. An image formation apparatus, comprising:

a body having a pair of frames;

an image formation unit provided between the pair of frames;

a first transport portion configured to feed a sheet to the image formation unit;

a second transport portion configured to feed the sheet from the image formation unit;

a third transport portion vertically provided between the pair of frames and connected with the second transport portion;

a curved transport portion provided between the pair of frames and connected with the third transport portion, the curved transport portion being formed by a longitudinal plate curved in a direction parallel with a sheet feed direction; and a fourth transport portion horizontally provided between the pair of frames and connected with the first transport portion and the curved transport portion;

wherein the curved transport portion curves from a lower end of the third transport portion toward the fourth transport portion;

wherein the third transport portion, the curved transport portion and the fourth transport portion define a duplex transport path such that the sheet is fed from the second transport portion to the first transport portion via the duplex transport path, wherein the fourth transport portion comprises a supporting member configured to support the sheet from below and guide the sheet, the supporting member extending horizontally, wherein an inclined portion is defined at an upstream side end portion of the supporting member, the inclined portion being recessed in a downward direction with respect to a horizontally extending plane of the supporting member, wherein an upstream end, in the sheet feeding direction, of the inclined portion is arranged at a level lower than a level of a downstream end, in the sheet feeding direction, of the inclined portion, and wherein the upstream end, in the sheet feeding direction, of the inclined portion is arranged at a level lower than a level of a downstream end, in the sheet feeding direction, of the longitudinal plate.

2. The image forming apparatus according to claim 1, wherein the longitudinal plate, which forms the curved transport portion, is made of metal.

3. The image forming apparatus according to claim 1, wherein the longitudinal plate connects the pair of frames.

4. The image formation apparatus according to claim 1, further comprising a first feeding member which contains resin and forms the fourth transport portion on a downstream side, in the sheet feed direction, of the plate.

5. The image formation apparatus according to claim 4, wherein the first feeding member includes:

an end regulating member arranged on one side in a width direction of the sheet, and having a regulation surface configured to regulate an end, in the width direction, of the sheet; and an obliquely feeding roller arranged on the one side, in the width direction of the sheet, and configured to feed the sheet so that the sheet is fed with approaching the end regulating member, and wherein the plate includes a guide member, which is arranged on the one side in the width direction, having a first guide surface extending from a position outside, in the width direction, of the regulation surface toward the regulation surface.

6. The image formation apparatus according to claim 5, wherein:

the first feeding member includes a member distinct from the body of the image formation apparatus;

an end portion of the member distinct from the body of the image formation apparatus at a side opposite, in the width direction, to the end regulating member engages with the body of the image formation apparatus; and an end portion of the end regulating member is fastened to the body with a fastening member.

7. The image formation apparatus according to claim 5, wherein the guide member has a lower wall portion configured to support the sheet; and wherein the lower wall portion extends from the plate side toward the first feeding member, and a downstream side end portion, in the sheet feed direction, of the lower wall portion is arranged above a support surface, which is configured to support the sheet, of the first feeding member.

8. The image formation apparatus according to claim 7, wherein:

the first feeding member includes an upper feeding member and a lower feeding member, which are arranged vertically with a predetermined clearance therebetween to form the duplex transport path;

on the one side, in the width direction, of the upper feeding member is formed with a cutout to which the guiding member is to be inserted;

the guide member has an upper wall portion facing the lower wall portion; and an other side, in the width direction, of the upper feeding member extends to a position where the other side of the upper feeding member and the plate overlap when viewed in the vertical direction, the other side of the upper feeding member and the upper wall portion overlapping when viewed in the width direction.

9. The image formation apparatus according to claim 8, wherein the upstream side end portion, in the sheet feed direction, of the lower feeding member is arranged at a level lower than the downstream side end portion, in the sheet feed direction, of the plate.

10. The image formation apparatus according to claim 4, wherein:

a second feeding member having a second guide surface configured to guide the sheet toward the plate is arranged on an upstream side, in the sheet feed direction, of the plate; and the upstream side end portion, in the sheet feed direction, of the plate is arranged at a position farther from the sheet than a downstream side end portion, in the sheet feed direction, of the second guide surface.

11. The image formation apparatus according to claim 10, wherein the second feeding member is supported rotatably with respect to the body of the image formation apparatus.

12. The image formation apparatus according to claim 10, wherein a cover member formed of resin is provided outside the plate such that the cover member covers from the downstream side end portion, in the sheet feed direction, of the second feeding member to the upstream side end portion, in the sheet feed direction, of the first feeding member.

* * * * *